US006026260A

United States Patent [19]

Aita et al.

[11] Patent Number: 6,026,260

[45] Date of Patent: Feb. 15, 2000

[54] ELECTROPHOTOGRAPHIC APPARATUS, IMAGE FORMING METHOD AND PROCESS CARTRIDGE

[75] Inventors: Shuichi Aita, Mishima; Fumihiro Arahira, Shizuoka-ken; Kiyoshi Mizoe; Toshio Takamori, both of Numazu, all of Japan

[73] Assignee: Canon Kabushiki Kaisha, Tokyo, Japan

[21] Appl. No.: 09/175,327

[22] Filed: Oct. 20, 1998

[30] Foreign Application Priority Data

Oct. 21, 1997 [JP] Japan ..... 9-288633

[51] Int. Cl.[7] ..... G03G 15/02

[52] U.S. Cl. ..... 399/175; 430/106.6

[58] Field of Search ..... 399/174, 175, 399/168, 148, 149, 150, 267, 176; 430/106.6, 108, 111; 361/221, 225

[56] References Cited

U.S. PATENT DOCUMENTS

| | | | |
|---|---|---|---|
| 5,406,353 | 4/1995 | Asanae | 399/174 |
| 5,595,850 | 1/1997 | Honjo et al. | 430/106.6 |
| 5,659,852 | 8/1997 | Chigono et al. | 399/175 |
| 5,885,740 | 3/1999 | Tokunaga et al. | 430/106.6 |

FOREIGN PATENT DOCUMENTS

| | | |
|---|---|---|
| 51-151545 | 12/1976 | Japan . |
| 56-104351 | 8/1981 | Japan . |
| 57-178257 | 11/1982 | Japan . |
| 58-40566 | 3/1983 | Japan . |
| 58-139156 | 8/1983 | Japan . |
| 58-150975 | 9/1983 | Japan . |
| 59-133569 | 7/1984 | Japan . |
| 59-133573 | 7/1984 | Japan . |
| 60-227265 | 11/1985 | Japan . |
| 61-57958 | 3/1986 | Japan . |
| 62-203182 | 9/1987 | Japan . |
| 63-133179 | 6/1988 | Japan . |
| 63-187267 | 8/1988 | Japan . |
| 64-20587 | 1/1989 | Japan . |
| 2-51168 | 2/1990 | Japan . |
| 2-302772 | 12/1990 | Japan . |
| 4-21873 | 1/1992 | Japan . |
| 4-116674 | 4/1992 | Japan . |
| 5-2287 | 1/1993 | Japan . |
| 5-2289 | 1/1993 | Japan . |
| 5-53482 | 3/1993 | Japan . |
| 5-61383 | 3/1993 | Japan . |
| 6-110253 | 4/1994 | Japan . |
| 6-118855 | 4/1994 | Japan . |
| 6-301265 | 10/1994 | Japan . |
| 7-20658 | 1/1995 | Japan . |
| 7-72667 | 3/1995 | Japan . |
| 7-92764 | 4/1995 | Japan . |
| 7-98530 | 4/1995 | Japan . |
| 8-22150 | 1/1996 | Japan . |
| 8-6355 | 1/1996 | Japan . |
| 8-69149 | 3/1996 | Japan . |
| 8-69155 | 3/1996 | Japan . |
| 8-69156 | 3/1996 | Japan . |
| 8-106200 | 4/1996 | Japan . |

*Primary Examiner*—Sandra Brase
*Assistant Examiner*—Sophia S. Chen
*Attorney, Agent, or Firm*—Fitzpatrick, Cella, Harper & Scinto

[57] ABSTRACT

An electrophotographic apparatus includes: an electrophotographic photosensitive member, a charging device including a charging member formed of magnetic particles and disposed contactable to the photosensitive member so as to charge the photosensitive member based on a voltage applied thereto, exposure device, developing device, and a transfer device. The magnetic particles exhibit a good charging ability for a long period and therefore provide a good continuous image-forming performance because they are formed of ferrite particles including a ferrite having a very limited composition represented by the formula of:

$$(MnO)_x(MgO)_y(Fe_2O_3)_z,$$

wherein x, y and z are numbers satisfying $x+y+z \leqq 1$, $0.2<x<0.5$, $0.05<y<0.25$ and $0.4<z<0.6$, and 0.01–3 wt. parts of phosphorus added per 100 wt. parts of the ferrite and contained preferentially at a larger concentration at the surfaces of the magnetic particles than in the entirety of the magnetic particles.

14 Claims, 7 Drawing Sheets

ELECTROPHOTOGRAPHIC APPARATUS, IMAGE FORMING METHOD AND PROCESS CARTRIDGE

FIELD OF THE INVENTION AND RELATED ART

The present invention relates to an electrophotographic apparatus including a charging member formed of magnetic particles. More specifically, the present invention relates to an electrophotographic apparatus, such as a copying apparatus, a printer or a facsimile apparatus, including a charging member formed of magnetic particles having a specific composition, particularly such an electrophotographic apparatus suitable for use in a cleanerless image forming method. The present invention also relates to a process cartridge for such an electrophotographic apparatus.

Hitherto, a large number of electrophoto-graphic processes have been known. In these processes, an electrostatic latent image is formed on a photosensitive member comprising a photoconductive material by various means, then the latent image is developed and visualized with a toner, and the resultant toner image is, after being transferred onto a transfer-receiving material, such as paper, as desired, fixed by heating, pressing, heating and pressing, etc., to obtain a copy or a print. The residual toner remaining on the photosensitive member without being transferred is removed in a cleaning step.

In such an electrophotographic apparatus, corona discharge means, such as the so-called corotron or scorotron, have been conventionally used as charging means, but are accompanied with difficulties, such as the occurrence of a substantial amount of ozone occurs at the time of the corona discharge for forming a negative corona or a positive corona, and the requirement that the electrophotographic apparatus be equipped with a filter for removing the ozone, resulting in a size enlargement and an increase in the running cost of the apparatus.

As a technical solution to such difficulties, a charging method for minimizing the occurrence of ozone has been developed, wherein a charging means, such as a roller or a blade, is caused to contact the photosensitive member surface to form a narrow gap in the proximity of the contact portion where a discharge appearing to follow the Paschen's law occurs (contact charging scheme), e.g., as disclosed in Japanese Laid-Open Patent Application (JP-A) 57-178257, JP-A 56-104351, JP-A 58-40566, JP-A 58-139156 and JP-A 58-150975.

According to the contact charging scheme, however, there is liable to occur a difficulty, such as toner melt-sticking onto the photosensitive member.

For this reason, there is also proposed a scheme of disposing a charging member in proximity to a photosensitive member so as to avoid a direct contact therebetween. The member for charging a photosensitive member may assume the form of a roller, a blade, a brush or an elongated electroconductive plate member coated with a resistance layer. Any of such members cause a difficulty in performing accurate proximity control, thus causing difficulty in the practical application of this feature.

As another alternative, it has been also proposed to use magnetic particles held on an electroconductive sleeve enclosing a magnet as a charging member exerting a relatively small contacting load onto the photosensitive member. For example, JP-A 59-133569 discloses a method wherein iron powder-coated particles are held on a magnet roll and are supplied with a voltage to charge a photosensitive member; and JP-A 7-72667 discloses the use of magnetic particles coated with a styrene-acrylic resin, etc., for improving the environmental stability.

These proposals have, however, make it difficult to ensure a stable charging ability during continuous use. To solve this problem, JP-A 6-301265 has proposed to replenish toner so as to retain a constant amount of toner in the magnetic brush, thereby stabilizing the resistivity.

As another new trial, there has been proposed a contact injection charging scheme, wherein a contact charging member, such as a charging roller, a charging brush or a charging magnetic brush, is supplied with a voltage to inject a charge into a trap level formed at a surface of a photosensitive member.

For example, JP-A 8-106200 has proposed a charging apparatus according to the contact injection charging scheme including an image-bearing member having a charge injection layer and a magnetic brush having a specific level of resistivity, thereby providing a satisfactory charging ability and an anti-pinhole leakage characteristic. As a result, it has become possible to obtain a charge potential that is substantially linear to an applied voltage because of no discharge initiation point associated with discharge phenomenon.

Further, for improving the durability or long-term performance of the contact injection charging method using magnetic particles, JP-A 8-6355 has proposed to use a mixture of magnetic particles having smooth surfaces and magnetic particles having uneven surfaces; JP-A 8-69156 has proposed a coating with a resin layer of charging magnetic particles; and JP-A 8-69149 has proposed charging magnetic particles having a particle size distribution provided with a plurality of peaks.

As described above, the injection charging scheme is not governed by discharge phenomenon and is therefore advantageous in that it is less liable to cause difficulties, such that the photosensitive member is damaged or deteriorates or causes image flow in a high temperature/high humidity environment due to discharge by-products.

On the other hand, it has been well known to use magnetic particles as a carrier for a toner in a developer (developing agent) for developing an electrostatic latent image in the field of electrophotography, but a sufficient study on properties of magnetic particles suitable as a charging member for charging a photosensitive member has not been made so far. Further, from the view-point of commercial application, there has been absolutely no commercial electrophotographic apparatus, such as copying machines, using a magnetic brush as a charging member for the photosensitive member on the market.

JP-A 51-151545 discloses a charging method using magnetic powder, and JP-A 61-57958 discloses a charging method using a semiconductive protective film and electroconductive particles, which are in the form of fine powder obtained by dispersing in a binder resin a powder of an electroconductive material inclusive of a metal, such as copper, nickel, iron, aluminum, gold or silver; iron oxide, ferrite, zinc oxide, tin oxide, antimony oxide, titanium oxide or carbon black.

JP-A 63-187267 discloses the charging of a drum of amorphous selenium with magnetic particles.

JP-A 4-116674 discloses metals such as iron, chromium, nickel and cobalt, triiron tetroxide, γ-ferric oxide, chromium dioxide, manganese oxide, ferrites, and manganese-copper alloy, as materials for such magnetic particles.

JP-A 7-98530 and JP-A 7-92764 disclose 3d-, 4d- and 5d-group metal-containing ferrite particles as charging magnetic particles while noting their activity of decomposing ozone generated during the charging.

However, the study of the composition of magnetic particles as a charging member for charging a photosensitive member in connection with an effect thereof has been still insufficient, and it is desired to develop magnetic particles having a composition suitable for use as charger particles.

On the other hand, in the cleaning step of an electrophotographic image forming method, a blade, a fur brush, a roller, etc., have been conventionally used as cleaning means. By such a cleaning means or member, the transfer residual toner is mechanically scraped off or held back to be recovered into a waste toner vessel. Accordingly, some problems have been caused by pressing of such a cleaning member against the photosensitive member surface. For example, by strongly pressing the member, the photosensitive member can be worn out to result in a short life of the photosensitive member. Further, from an apparatus viewpoint, the entire apparatus is naturally enlarged because of the provision of such a cleaning device, thus providing an obstacle to developing a smaller apparatus.

Further, from an ecological viewpoint and effective utilization of a toner, a system not resulting in a waste toner has been desired.

In order to solve the above-mentioned problems accompanying the provision of a separate cleaning system, a so-called simultaneous developing and cleaning system or cleaner-less system has been proposed wherein a separate cleaning means for recovering and storing residual toner remaining on the photosensitive member after the transfer step is not provided between the transfer position and the charging position or between the charging position and the developing position, but the cleaning is performed by the developing means. Examples of such a system are disclosed in JP-A 59-133573, JP-A 62-203182, JP-A 63-133179, JP-A 64-20587, JP-A 2-51168, JP-A 2-302772, JP-A 5-2287, JP-A 5-2289, JP-A 5-53482 and JP-A 5-61383. In these proposed systems, however, a corona charger, a fur brush charger and a roller charger are used as the charging means, and it has not been fully successful to solve such problems as the soiling of the photosensitive member surface with discharge products and charging non-uniformity.

For this reason, there has been proposed a cleaner-less system using a magnetic brush formed of magnetic particles held by a magnet as a charging member exerting a comparatively small contact load onto a photosensitive member. For example, JP-A 4-21873 discloses an image forming apparatus using a magnetic brush supplied with an AC voltage having a peak-to-peak voltage exceeding a discharge threshold value for removing the necessity of a cleaning apparatus. Further, JP-A 6-118855 discloses an image forming apparatus including a simultaneous magnetic brush charging and cleaning system without using an independent cleaning apparatus. This Japanese reference also discloses examples of the magnetic particles including: particles of metals, such as iron, chronium, nickel and cobalt and compounds and alloys of these metals, triiron tetroxide, γ-ferric oxide, chromium dioxide, manganese oxide, ferrites and manganese-copper alloys, these particles further being coated with a resin, such as styrene resin, vinyl resin, ethylene resin rosin-modified resin, acrylic resin, polyamide resin, epoxy resin, polyamide resin, epoxy resin, or polyester resin, and particles obtained by dispersing fine powder of such magnetic materials in a resin as described above. JP-A 4-21873 discloses iron powder, iron oxide powder and various ferrite powder. However, these references fail to disclose a preferred composition of such magnetic particles and have not solved the problem of providing magnetic particles suitable for use in the cleaner-less electrophotographic system.

As for developer carriers, JP-A 8-22150 discloses a developer carrier comprising a composition of $MnO/MgO/Fe_2O_3$, which is partly replaced by SrO for reducing a fluctuation in magnetic properties.

Further, JP-A 8-69155 discloses charger magnetic particles comprising ferrite particles of $Li_2O/MnO/MgO$, to which a component, such as $Na_2O$, $K_2O$, CaO, SrO, $Al_2O_3$, $SiO_2$ or $Bi_2O_3$, is added for providing a solid solution.

Further, JP-A 60-227265 discloses a developer carrier of $MgO/ZnO/Fe_2O_3$ ferrite, to which at least one species selected from V-group elements of P, As, Sb, Bi and V is added for preventing peeling from or breakage of crystalline particles.

Further, JP-A 6-110253 discloses a developer carrier comprising resin-coated magnetic particles having a composition of $CuO/ZnO/Fe_2O_3$ to which an element, such as P or As is added for preventing the photosensitive member from being damaged with broken particles in the cleaning step. JP-A 7-20658 discloses a developer carrier of ferrite particles of $(MO)_{100-x}(Fe_2O_3)_x$ (M is a soft ferrite-forming element such as Cu, Zn, Fe, Co, Ni, Mn, Cd or Mg; $40 \leqq x < 100$) to which phosphorus (P) or phosphorus oxide is added for controlling the static resistivity but does not refer at all to the applicability thereof to charger magnetic particles.

As described above, it has been desired to provide charger magnetic particles suitable for use as a charging member for charging a photosensitive member, that is, a magnetic brush charging member exhibiting a charging ability that is stable in continuous use for a long term and is little affected by a change in environmental conditions but a composition study on such magnetic particles has been insufficient.

It is also desired to provide a charging member capable of exhibiting a stable chargeability and also capable of well treating a residual toner even in the cleaner-less electrophotographic image forming system.

SUMMARY OF THE INVENTION

In view of the above-mentioned problems, a principal object of the present invention is to provide an electrophotographic apparatus and a process cartridge therefor using charger magnetic particles exhibiting excellent long-term performances.

Another object of the present invention is to provide an electrophotographic apparatus and a process cartridge therefor including a cleaner-less system using a magnetic brush charging member and capable of providing stable images for a long period.

According to the present invention, there is provided an electrophotographic apparatus, comprising:

an electrophotographic photosensitive member, a charging means including a charging member formed of magnetic particles and disposed contactable to the photosensitive member so as to charge the photosensitive member based on a voltage applied thereto, exposure means, developing means, and transfer means;

wherein the magnetic particles comprise ferrite particles comprising a ferrite having a composition represented by the formula of:

$(MnO)_x(Mgo)_y(Fe_2O_3)_z$, wherein x, y and z are numbers satisfying $x+y+z \leqq 1$, $0.2<x<0.5$, $0.05<y<0.25$ and $0.4<z<0.6$, and 0.01–3 wt. parts of phosphorus added per 100 wt. parts of the ferrite and contained preferentially at a larger concentration at surfaces of the magnetic particles than in the entirety of the magnetic particles.

According to another aspect of the present invention, there is provided a process cartridge, comprising an electrophotographic photosensitive member, and a charging means including a charging member formed of the above-mentioned magnetic particles and disposed contactable to the photosensitive member so as to charge the photosensitive member based on a voltage applied thereto, the electrophotographic photosensitive member and the charging means being integrally supported to form a cartridge which is detachably mountable to a main assembly of electrophotographic apparatus.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
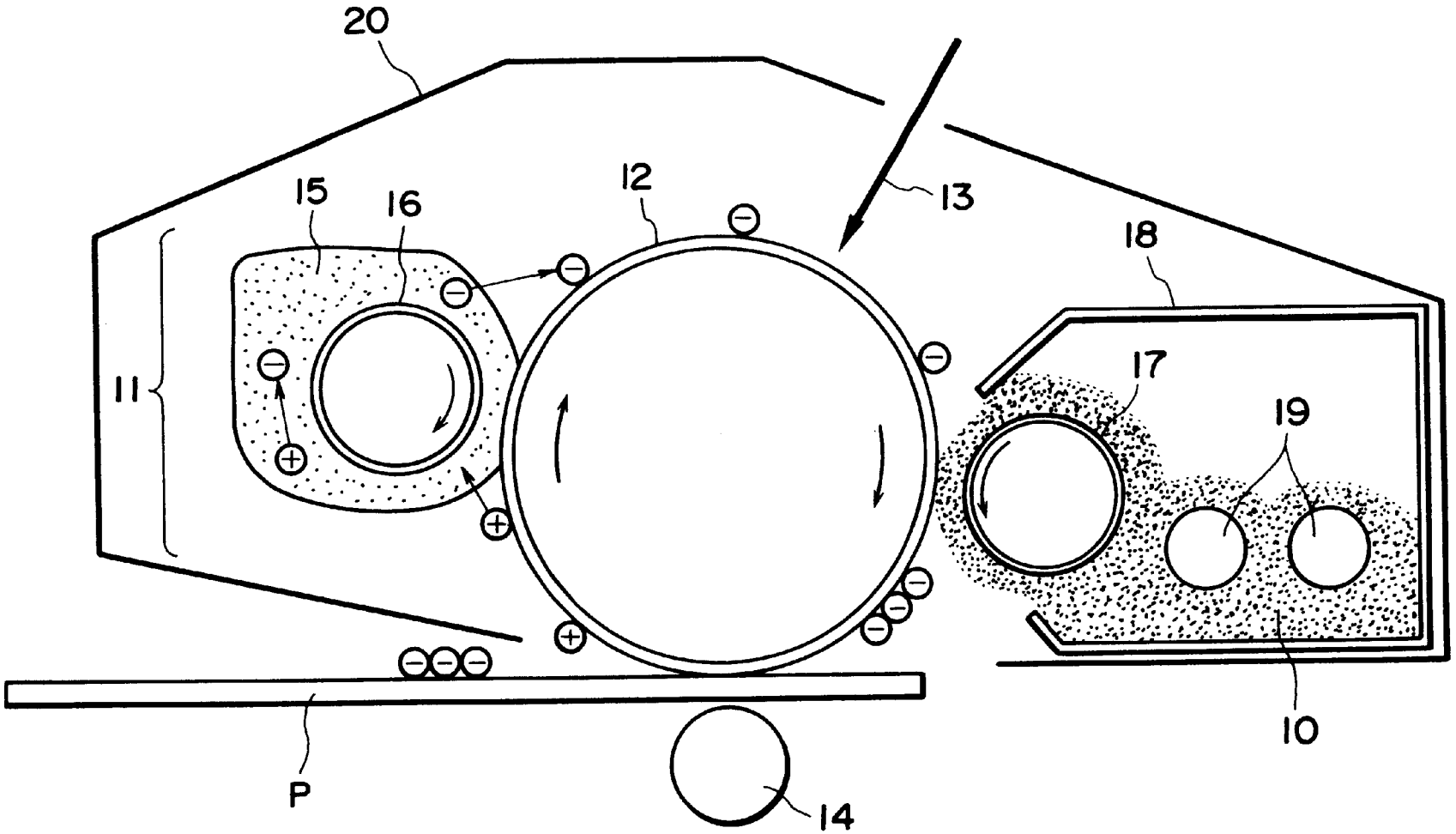
FIG. 1 is a schematic sectional view for illustrating a principle of a cleaner-less electrophotographic apparatus including a process cartridge.

The magnetic particles for constituting the charging member used in the electrophotographic apparatus and the process cartridge according to the present invention comprise ferrite particles comprising a ferrite having a composition represented by the formula of:

$(MnO)_x(MgO)_y(Fe_2O_3)_z$, wherein x, y and z are numbers satisfying $x+y+z \leqq 1$, $0.2<x<0.5$, $0.05<y<0.25$ and $0.4<z<0.6$, and 0.01–3 wt. parts of phosphorus added per 100 wt. parts of the ferrite and contained preferentially at a larger concentration at surfaces of the magnetic particles than in the entirety of the magnetic particles.

A principal characteristic feature of the present invention resides in the use of magnetic particles having a very limited composition as described for constituting a charging member to provide the charging member with a remarkably improved durability or long-term performance.

The charging ability of charger magnetic particles may deteriorate due to factors as follows:

(1) a current deterioration caused by continually passing a charging current to a photosensitive member through the magnetic particles, (2) soiling with dust powder of the photosensitive member caused due to rubbing of the photosensitive member with the magnetic particles, (3) soiling with a residual toner having passed by a cleaner, if used, (4) soiling with a residual toner in a cleaner-less electrophotographic system, (5) particle surface abrasion due to friction between individual charger particles because of the small number of toner particles possibly exhibiting a lubrication action, if present between the charger particles, than in the developing device.

The improved performance of the charger magnetic particle used in the present invention may be attributable to a uniformized surface conductivity due to the abundant presence of phosphorus at the ferrite particle surfaces caused by a relatively low melting point and low solid solution-formability with ferrite of phosphorus, but the mechanism of the improvement is still being investigated and has not been fully clarified as yet. It is, however, clear that the charger magnetic particles satisfying the above-mentioned specific composition exhibit much better durability than magnetic particles having compositions outside the specific composition as is understood from Examples and Comparative Examples described hereinafter.

The phosphorus concentration at the surface (more exactly, in proximity to the surface) of magnetic particles referred to herein is based on values measured according to ESCA (electron spectroscopy for chemical analysis, particularly X-ray photoelectron spectroscopy). More specifically, the values were measured according to the following method.

Sample magnetic particles are attached to a cellophane adhesive tape and affixed on a carbon sheet. An X-ray photoelectron spectroscope ("Model 1600S", available from ULVAC-PHI K.K.) was used together with an X-ray source of MgKa rays (400 W) for measurement in a region of 800 $\mu$m in diameter. The concentrations (atomic %) of the respective elements are estimated from the peak strengths of the respective peaks based on relative sensitivity factors provided by the apparatus supplier. The phosphorus concentration at the surface of the magnetic particles is determined in terms of atomic % relative to the total atomic percentages of the other metal elements in this ferrite. According to this method, the phosphorus concentration up to the depth of several tens of nm from the surface can be measured.

On the other hand, the phosphorus concentration in the entirety of the magnetic particles referred to herein is based on values measured according to the ICP-AES method (inductively coupled plasma-atomic emission spectroscopy) by using an apparatus ("ICAP-Model 575", available from Nippon Jarrel Ash K.K.) for a solution sample obtained by alkali melting or the addition of an acid such as fluoric acid, hydrochloric acid or sulfuric acid, etc. From the measured composition, the phosphorus concentration in the entirety of the magnetic particles is determined in terms of atomic % relative to the total atomic percentages of the other metal elements in the ferrite.

A ratio is obtained between the two types of phosphorus concentrations as a measure for the preferential presence of phosphorus at the surface of the magnetic particles.

The magnetic particles used in the present invention are characterized by their surface shape having a characteristically deep gap between adjacent crystallites and exhibiting a property that the soiling of the surface portion exhibiting the charging ability is less liable to be soiled with a soiling substance arising from the residual toner particularly in the cleaner-less system because the soiling substance is introduced into the gap.

If the phosphorus content in the ferrite is less than 0.01 wt. part, the characteristic effect of the present invention becomes insufficient and, in excess of 3 wt. parts, the magnetic properties of the ferrite is impaired and the production of the magnetic particles becomes difficult.

In order to enhance the effect of the present invention, it is preferred that the magnetic particles are surface-treated with a coupling agent including a linear alkyl group structure having at least 6 carbon atoms in a straight chain.

The photosensitive member is strongly rubbed by the charger magnetic particles so that the photosensitive member is liable to be abraded especially in the case of an organic photosensitive member. If the magnetic particles are surface-treated with such a coupling agent having a long-chain alkyl group, the long-chain alkyl group imparts a lubricity, thereby alleviating the damage of the photosensitive member and also reducing the surface soiling of the charger magnetic particles. This effect is particularly pronounced in the case where the photosensitive member has a surface layer comprising an organic compound.

From the above viewpoints, the alkyl group may preferably have at least 6 carbon atoms, more preferably at least 8 carbon atoms, and at most 30 carbon atoms. If the number of carbon atoms is less than 6, the above-mentioned effects are scarce. In excess of 30, the coupling agent is liable to be insoluble in a solvent so that the uniform application thereof onto the magnetic particle surfaces becomes difficult, and the resultant treated charger magnetic particles are liable to have remarkably inferior flowability and accordingly exhibit non-uniform charging ability.

The coupling agent may preferably be used in an amount of 0.0001–0.5 wt. % of the treated charger magnetic particles. Below 0.0001 wt. %, the effect of the coupling agent is insufficient, and above 0.5 wt. %, the treated charger magnetic particles are liable to have inferior flowability. An amount of 0.001–0.2 wt. % is further preferred.

The content of the coupling agent can be evaluated by the heating loss of the treated magnetic particles. Accordingly, the charging magnetic particles used in the present invention may preferably exhibit a heating loss of at most 0.5 wt. %, more preferably at most 0.2 wt. %, in terms of a % weight loss measured by a thermobalance when heated from 150° C. to 800° C. in a nitrogen atmosphere.

In the present invention, the magnetic particles may preferably be coated with the coupling agent alone but can be coated with the coupling agent in combination (i.e., in mixture or in superposition) with a resin, preferably in a minor amount of at most 50 wt. % of the total coating.

Further, the coupling agent-coated magnetic particles can be used in combination with resin-coated magnetic particles in an amount of preferably at most 50 wt. % of the total charging magnetic particles contained in the charging device. Above 50 wt. %, the effect of the charging magnetic particles according to the present invention can be diminished.

More specifically, the above-mentioned coupling agent preferably used in the present invention refers to a compound having a molecular structure including a central element, such as silicon, aluminum titanium or zirconium, and a hydrolyzable group and a hydrophobic group. The hydrophobic group comprises the above-mentioned long-chain alkyl group.

The coupling agent has a hydrolyzable group. Preferred examples thereof may include alkoxy groups having relatively high hydrophilicity, such as methoxy group, ethoxy group, propoxy group and butoxy group. In addition, it is also possible to use acryloxy group, methacryloxy group, halogen, or a hydrolyzable derivative of these.

The hydrophobic group of the coupling agent includes a linear alkyl group structure having 6 carbon atoms in a straight chain, which may be bonded to the central atom via a carboxylic ester, alkoxy, sulfonic ester or phosphoric ester bond structure, or directly. The hydrophobic group can further include a functional group, such as an ether bond, an epoxy group or an amide group in its structure.

Preferred but non-exaustive examples of coupling agents preferably used in the present invention may include the following:

$(CH_3O)_3$—Si—$C_{12}H_{25}$ $(CH_3O)_3$—Si—$C_{18}H_{37}$ $(CH_3O)_3$—Si—$C_8H_{17}$ $(CH_3O)_2$—Si—$(C_{12}H_{25})_2$

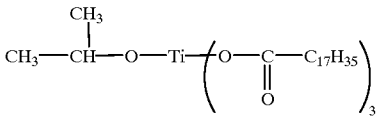

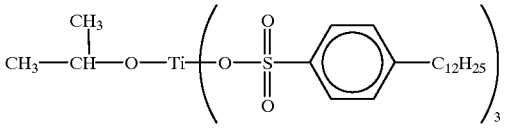

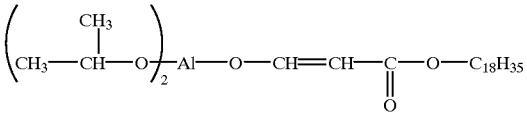

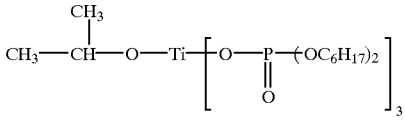

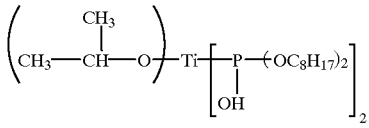

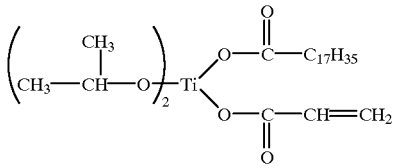

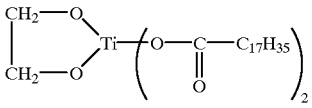

$C_6H_{13}$—$SiCl_3$

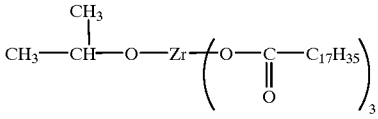

As the coupling agent preferably used in the present invention can exhibit a sufficient effect at a coating level of at most 0.5 wt. %, preferably at most 0.2 wt. %, the coated charging magnetic particles of the present invention can exhibit a resistivity comparable to that of non-coated magnetic particles and accordingly can exhibit higher stability in production or of quality than magnetic particles surface-coated with a layer of electroconductive particle-dispersed resin.

It is preferred that the coupling agent is reacted with the magnetic particles at a ratio of at least 80%, more preferably at least 85%. As the coupling agent has a relatively long alkyl group, a larger proportion of non-reacted coupling agent is liable to result in treated magnetic particles having an inferior flowability. Further, in case where the magnetic particles are used for charging a photosensitive member having a surface layer comprising a substantially non-crosslinked resin, the non-reacted portion of the coupling agent can penetrate into the photosensitive member surface, thus resulting in a turbid or cracked surface. For this reason, it is preferred to use a coupling agent exhibiting a high reactivity with the magnetic particles.

The reaction ratio of the coupling agent of the treated magnetic particles may be determined by washing the treated magnetic particles with a solvent capable of dissolving the coupling agent and measuring the contents of the coupling agent before and after the washing. For example, the treated magnetic particles may be immersed for washing in 100 times by weight of a solvent to measure the amount of the coupling agent dissolved in the solvent by chromatography. It is also possible to measure the content of the coupling agent remaining at the surface or within the magnetic particles after the washing by a method, such as ESCA, elementary analysis or thermogravimetric analysis (TGA), and compare the data before the washing.

The charger magnetic particles used in the present invention may preferably have a volume resistivity of $1\times10^4$–$1\times10^9$ ohm.cm. Below $1\times10^4$ ohm.cm, the magnetic particles are liable to cause pinhole leakage, and in excess of $1\times10^9$ ohm.cm, the magnetic particles are liable to exhibit inferior performance of charging the photosensitive member.

Figure 2:
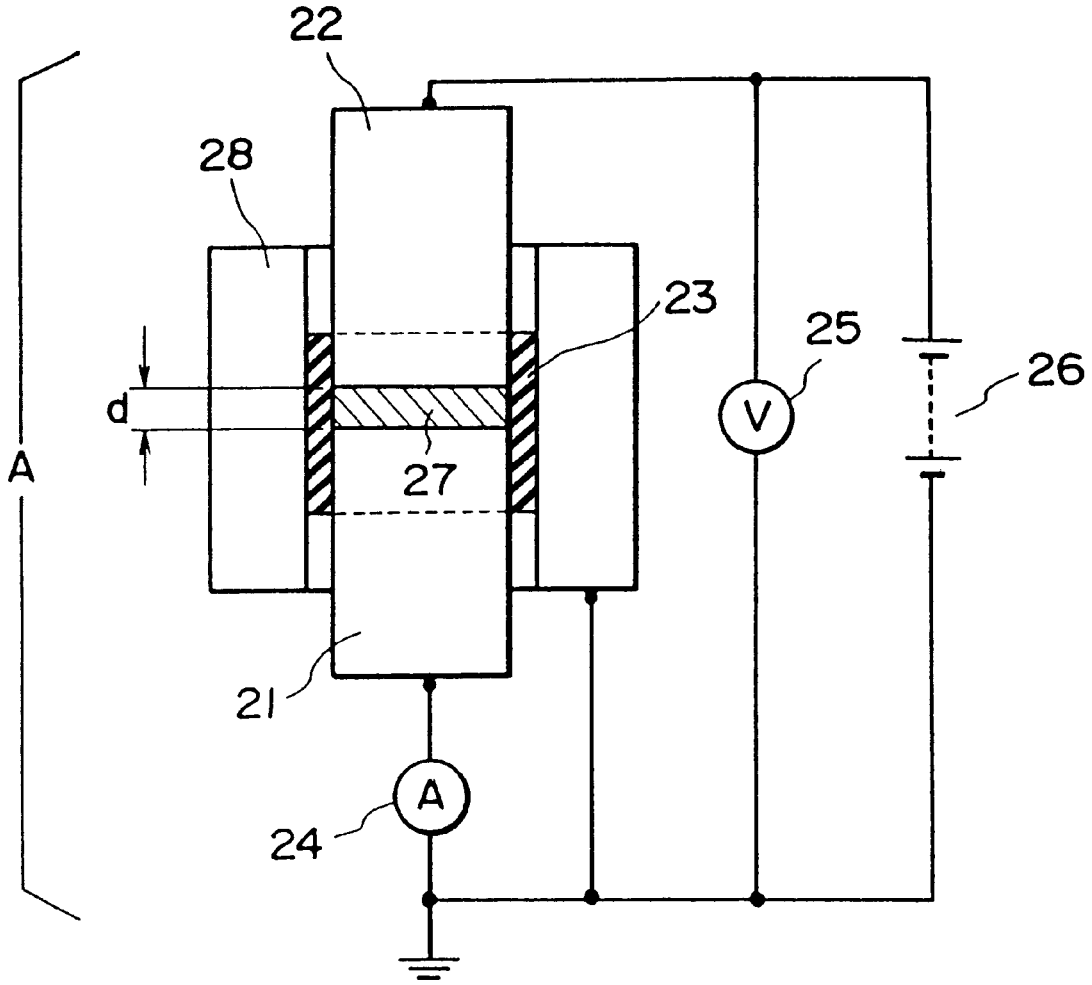
FIG. 2 is an illustration of an apparatus for measuring the volume resistivity of magnetic particles.

The volume resistivity values of magnetic particles described herein are based on values measured in the following manner. A cell A as shown in FIG. 2 is used. Into the cell A having a sectional area (=2 $cm^2$) and held in a guide ring 28 via an insulating material 23, magnetic particles 27 are placed, and a principal electrode 21 and an upper electrode 22 are disposed to sandwich the magnetic particles 27 in a thickness d (=1 mm), under a load of 10 kg. Under this state, a voltage of 100 volts supplied from a constant voltage supply 26 and measured by a volt meter 25 is applied, and a current passing through the sample magnetic particles 27 is measured by an ammeter 24 in an environment of 23° C. and 65%.

Now, the principle of a cleaner-less electrophotographic image-forming system as a preferred embodiment of the electrophotographic apparatus according to the present invention will be described with reference to FIG. 1.

A magnetic brush charger 11 is constituted by a non-magnetic electroconductive sleeve 16 enclosing a magnet therein and magnetic particles 15 held thereon and is used to charge a photosensitive member 12. The thus-charged photosensitive member 12 is exposed to image light 13 from an exposure means (not shown) to form an electrostatic latent image thereon. The latent image is subjected to reversal development by a developing apparatus 18 including e.g., a developer 10, an electroconductive non-magnetic sleeve 17 enclosing therein a magnet and stirring screws 19 for stirring the developer 10 in the apparatus to form a visualized toner image on the photosensitive member 12. The toner image is then transferred onto a transfer-receiving material P. such as paper, by a transfer means 14 to leave transfer residual toner on the photosensitive member 12. The transfer residual toner can have various charge polarities ranging from negative to positive (negatively charged toner particles and positively charged residual toner particles are represented by ⊖ and ⊕, respectively, in FIG. 1) according to the influence of a transfer bias electric field exerted by the transfer means. Such transfer residual toner is subjected to rubbing with a rotating magnetic brush charger 11 comprising the photosensitive members 15, thereby being scraped off and controlled to a desired polarity (negative in this embodiment) due to triboelectrification with the magnetic particles 15 while the photosensitive member 12 is charged by the magnetic brush charger 11 (to a negative charge). The charge-controlled residual toner particles are distributed uniformly at a very low density on the photosensitive member and subjected to a subsequent image forming cycle, thus leaving substantially no adverse effects on the subsequent image forming cycle including the imagewise exposure step.

Accordingly, even in the case of using a so-called magnetic brush charger utilizing a discharge phenomenon, it becomes possible to allow clear image formation by utilizing the discharge or tribo-electrification with the magnetic particles constituting the magnetic brush and without using a separate cleaning means.

Further, even in the case of using a contact injection charging system not utilizing a discharge phenomenon, the transfer residual toner can be controlled to a desired polarity owing to triboelectrification with the magnetic particles, thereby allowing clear image formation without using a separate cleaning means.

In the present invention, the charger magnetic particles may preferably have an average particle size in the range of 5–100 μm. More specifically, below 5 μm, the magnetic particles are liable leak out of the charging device, and above 100 μm, the magnetic particles are liable to exhibit a noticeably ununiform charging ability. A range of 15–80 μm is further preferred. Particularly, in the injection charging system wherein the photosensitive member is charged only through points of contact with the magnetic particles, the magnetic particles may preferably have an average particle size of 15–40 μm, so as to provide an increased contact probability, thereby ensuring a sufficient ability for charging the photosensitive member.

The average particle size values of magnetic particles referred to herein are based on values measured by using a laser diffraction-type particle size distribution meter ("HEROS", available from Nippon Denshi K.K.) in a range of 0.5–200 μm divided into 32 fractions on a logarithmic scale, and based on a measured distribution, a median particle size (diameter) giving cum-ulatively a volume corresponding to 50% of the total volume is taken as an average particle size (volume 50%-average particle size, denoted by Dav. or $Dv_{50\%}$).

In the present invention, it is preferred to use a photosensitive member having a charge-injection layer as a layer most distant from the support, i.e., a surface layer. As a result, the photosensitive member can be charged to a potential that is at least 80%, further at least 90%, of the absolute value of a DC component of applied voltage without causing discharge. Accordingly, it is possible to use a lower applied voltage and realize a better degree of ozone-less less charging system than the charging method following Paschen's law. The charge-injection layer may preferably have a volume resistivity of $1\times10^8$ ohm.cm–$1\times10^{15}$ ohm.cm so as to have a sufficient chargeability and avoid image flow. It is particularly preferred to have a volume resistivity of $1\times10^{10}$ ohm.cm–$1\times10^{15}$ ohm.cm, in order to avoid the image flow, and further preferably $1\times10^{12}$–$1\times10^{15}$ ohm.cm in view of environmental change. Below $1\times10^{8}$ ohm.cm, charge carrier is not retained along the surface in a high-humidity environment, thus being liable to cause image flow. Above $1\times10^{15}$ ohm.cm, charge cannot be sufficiently injected from the charging member and retained, thus being liable to cause a charging failure.

The charge injection layer may be formed of a medium resistivity material obtained by dispersing an appropriate amount of optically transparent and electroconductive particles in an insulating binder resin, or may be formed as an inorganic layer having a volume resistivity level as described above. Such a functional surface layer effectively retains a charge injected from the charging member and releases the charge to the support of the photosensitive member at the time of imagewise exposure.

For the measurement of a volume resistivity of a surface layer of a photosensitive member, a 3 μm-thick layer of a material constituting the objective surface layer (a charge transport layer or a charge injection layer, if present, in the case of a photosensitive member) is formed on an Au layer formed by vapor deposition on a polyethylene terephthalate (PET) film and subjected to measurement by using a volume resistivity measurement apparatus ("4140B pAMATER", available from Hewlett-Packard Co.) under application of a voltage of 100 volts in an environment of 23° C. and 65% RH.

In view of the optical transparency, the electroconductive particles may preferably have an average particle size of at most 0.3 μm, optimally at most 0.1 μm. The electroconductive particles may be added in a proportion of 2–250 wt. parts, preferably 2–190 wt. parts, respectively per 100 wt. parts of the binder resin. Below 2 wt. parts, it is difficult to obtain a desired volume resistivity level, and in excess of 250 wt. parts, the resultant charge injection layer is liable to have a weak strength and be readily peeled off. The charge injection layer may preferably have a thickness of 0.1–10 μm, optimally 1–7 μm.

The charge injection layer may preferably further contain lubricant particles, so that a contact (charging) nip between the photosensitive member and the charging member at the time of charging becomes enlarged thereby, due to a lowered friction therebetween, thus providing improved charging performance. Further, as the photosensitive member surface is provided with an improved releasability, the magnetic particles are less liable to be attached thereto. The lubricant powder may preferably comprise a fluorine-containing resin, silicone resin, or polyolefin resin having a low critical surface tension. A fluorine-containing resin, particularly polytetrafluoroethylene (PTFE) resin, is further preferred. In this instance, the lubricant powder may be added in 2–50 wt. parts, preferably 5–40 wt. parts, per 100 wt. parts of the binder resin. Below 2 wt. parts, the lubricant is insufficient, so that the improvement in charging performance is insufficient. Further, the transfer residual toner is liable to be increased, and this is undesirable for providing a cleaner-less system. Above 50 wt. parts, the image resolution and the sensitivity of the photosensitive member are remarkably lowered.

Further, in the case of forming an inorganic charge injection surface layer, it is preferred to dispose a photoconductor layer of amorphous silicon therebelow. More specifically, it is preferred to successively form a barrier layer, a photoconductor layer and a charge layer, in this order, by a glow discharge process, etc., on a cylinder (an electroconductive support).

The photosensitive layer may comprise a known material, e.g., a phthalocyanine pigment or an azo pigment, as an organic photoconductor material.

It is also possible to dispose an intermediate layer between the charge injection layer and the photosensitive layer. Such an intermediate layer may function to enhance the adhesion between the charge injection layer and the photosensitive layer or function as a charge barrier layer. Such an intermediate layer may comprise a commercially available resin, such as epoxy resin, polyester resin, polyamide resin, polystyrene resin, acrylic resin or silicone resin.

The photosensitive layer of the photosensitive member is generally supported on an electroconductive support, which may for example comprise a metal, such as aluminum, nickel, stainless steel or steel, a plastic or glass material coated with an electroconductive film, or electroconductivity-imparted paper.

The charging magnetic particles used in the present invention may preferably exhibit a certain range of charging ability for the toner used in combination therewith in terms of a triboelectric charge of the toner charged therewith. More specifically, the toner used may preferably exhibit an absolute value of a triboelectric charge in the range of 1–90 mC/kg, more preferably 5–80 mC/kg, and further preferably 10–40 mC/kg, in a charging polarity identical to that of the photosensitive member charged thereby, so as to provide a good balance among toner take-in and send-out performances and ability of charging the photosensitive member, when a mixture of 100 wt. parts of the magnetic particles and 7 wt. parts of the toner used is subjected to a triboelectric chargeability measurement in the following manner.

Figure 3:
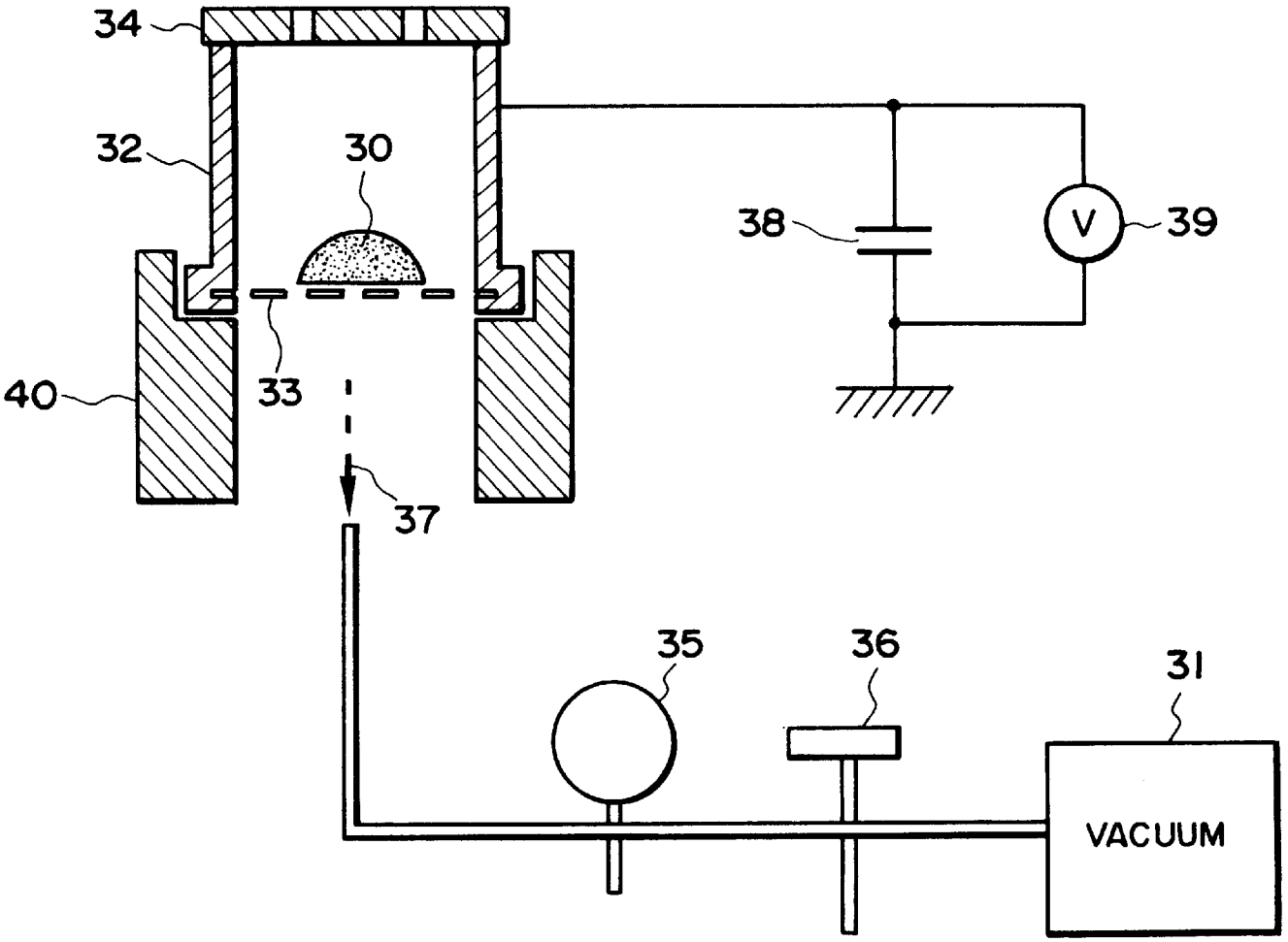
FIG. 3 is an illustration of an apparatus for measuring a toner triboelectric charge.

An outline of the measurement apparatus is illustrated in FIG. 3. Referring to FIG. 3, in an environment of 23° C. and 60% RH (relative humidity), a mixture 30 of 0.040 kg of magnetic particles and 0.0028 kg of a toner is placed in a polyethylene bottle (not shown) of 50–100 ml in volume, and the bottle is shaken 150 times by hands. Then, 0.0005 kg of the mixture 30 is placed in a metal measurement vessel 32 provided with a 500-mesh screen 33 at the bottom and is covered with a metal lid 34. At this time, the entire measurement vessel 32 is weighed at $W_1$ kg. Then, the mixture 30 is sucked through an aspirator 40 (of which at least a portion contacting the vessel 32 is composed of an insulating material), and a suction port 37 connected to a vacuum system 31 while adjusting a control valve 36 to provide a pressure of 250 mmAq. at a vacuum gauge 35. In this state, the toner is sufficiently sucked for 3 min. (possibly together with a minor proportion of the magnetic particles). Thereafter, a potential meter 39 connected via a capacitor 38 having a capacitance of C (mF) is read at a potential of V (volts). After the suction, the entire measurement vessel is weighed at $W_2$ (kg). In case where substantially no magnetic particles are passed through the screen 33, the triboelectric charge Q' (mC/kg) of the toner is calculated from the measured values according to the following equation:

$$Q'(mC/kg)=C\ V/(W_1-W_2).$$

In the case of using the charging magnetic particles of the present invention having an average particle size of, e.g., 40 μm or below, a substantial proportion thereof can pass through even the 500-mesh screen 33. In this case, the triboelectric charge Q (mC/kg) of the toner is calculated according to the following equation on an assumption that the charge of the portion of the magnetic particles having passed through the screen 33 is canceled with the triboelectric charge of the toner:

$$Q(mC/kg)=C\ V/(M_3.M_2/(M_1+M_2)],$$

wherein $M_1$ and $M_2$ denote the weights (0.040 kg and 0.0028 kg) of the magnetic particles and the toner in the initially prepared mixture, and $M_3$ denotes the weight (0.0005 kg) of the portion of the mixture 30 placed in the measurement vessel 32.

In the electrophotographic apparatus of the present invention, a magnetic brush formed of the magnetic particles described heretofore is used as a charging member so as to constitute a part of the charging means (charging device), and the charging means may suitably be formed by coating an electroconductive sleeve 16 enclosing therein a magnet (a magnetic particle-retention number) uniformly with such magnetic particles 15 as illustrated in FIG. 1. The magnetic particle-retention member 16 may suitably be disposed with a minimum gap of 0.3–2.0 mm from a photosensitive member 12. If the gap is smaller than 0.3 mm, electrical leakage can occur between an electroconductive portion of the retention member 16 and the photosensitive member, thereby causing damage to the photosensitive member, while it depends on the level of voltage applied to the member 16.

The charging magnetic brush 15 can move in an identical or a reverse direction with respect to the moving direction of the photosensitive member 12 at their position of contact, but a reverse direction (as shown in FIG. 1) may be preferred in view of the performances of taking in and uniformly charging the transfer residual toner.

The charging magnetic particles 15 may preferably be held on the retention member 16 at a rate of 50–500 mg/cm$^2$, and further preferably 100–300 mg/cm$^2$, so as to exhibit a particularly stable charging ability.

In the case of the injection charging process, the charging bias voltage can be composed of a DC component alone, but some improvement in image quality may be attained if some AC component is superposed on the DC component. The DC component may have a voltage which may be almost equal to or slightly higher than a desired surface potential of the photosensitive member. While depending on the charging or image forming process speed, the AC component may preferably have a frequency of about 100 Hz to 10 kHz and a peak-to-peak voltage of at most ca. 1000 volts. In excess of 1000 volts, a potential can occur on the photosensitive member in response to the applied voltage, thereby resulting in potential waving on the latent image surface leading to fog or lower image density.

In the discharge-based contact charging system, the charging bias voltage may preferably comprise an AC-superposed DC voltage. In case where a DC voltage alone is applied, the absolute value of the DC voltage has to be substantially higher than the desired surface potential or the photosensitive member. The AC component may preferably have a frequency of ca. 100 Hz–10 kHz and a peak-to-peak voltage of ca. 1000 volts or higher, at least two times the discharge initiation voltage, while it can depend on the process speed. Such a high AC voltage is preferred in order to attain a sufficient smoothing effect between the magnetic brush and the photosensitive member surface. The AC component may have a waveform in the shape of a sine wave, a rectangular wave or a sawteeth wave. In case of applying an AC component having a peak-to-peak voltage that is two or more times the discharge initiation voltage, the DC component may have a voltage which is almost equal to a desired surface potential of the photosensitive member.

It is possible to retain an excessive amount of the charging magnetic particles and circulate the magnetic particles in the charging device.

In the electrophotographic apparatus according to the present invention, the exposure means may comprise known means, such as a laser or an LED.

The developing means are not particularly limited, but as the image forming apparatus according to a preferred embodiment of the present invention does not include a separate cleaning means, a developing means according to the reversal development mode is preferred and may preferably have a structure wherein the developer contacts the photosensitive member. Examples of the preferred developing method include a contact two-component developing method and a contact mono-component developing method. This is because, in case where the developer and the transfer residual toner contact each other on the photosensitive member, the transfer residual toner can be effectively recovered by the developing means due to the frictional force in addition to the electrostatic force. The developing bias voltage may preferably have a DC component which exhibits a potential between a black image portion (an exposed portion in the case of reversal development) and a white image portion.

The transfer means may comprise a known form, such as a corona charger, a roller or belt charger, etc.

In the present invention, the electro-photographic photosensitive member and the charging device, and optionally the developing means, may be integrally supported to form an integral unit (cartridge), (e.g. a cartridge 20 in the embodiment shown in FIG. 1), which can be detachably mountable to a main assembly. Unlike in the embodiment shown in FIG. 1, the developing means can also be formulated into a cartridge separate from a cartridge including the electrophotographic photosensitive member and the charging device.

In the present invention, it is unnecessary to change the bias voltage applied to the charger (charging device) for conveying and transferring the transfer residual toner once recovered in the charger via the photosensitive member surface to the developing means for recovery and re-utilization. However, e.g., in the case of paper jamming or in the case of continually forming images of a high image proportion, the amount of transfer residual toner contained in the charger can increase to an extraordinarily high level. In such a case, it is possible to transfer the recovered transfer residual toner from the charger to the developing device in a period of no image formation on the photosensitive member during the operation of the electrophotographic apparatus. The period of no image formation refers to, e.g., a period of pre-rotation, a period of post-rotation, a period of successive sheet supplies of transfer-receiving material, etc. In that case, the charging bias voltage can be change to a level promoting the transfer of transfer residual toner from the charger to the developing device, e.g., by reducing the peak-to-peak voltage of the AC component, by applying only the DC component, or by reducing the AC effective value by changing not the peak-to-peak voltage but the waveform.

The toner used in the present invention is not particularly limited but may preferably be one exhibiting a high transfer efficiency so as to obviate the toner scattering. More specifically, if the amount of the transfer residual toner contacting the magnetic brush is reduced, the entire amount of the toner possibly causing the toner scattering is reduced, thereby exhibiting a large effect of combination with the electrophotographic apparatus of the present invention. A toner tends to show a good transferability if it has shape factors SF-1 of 100–160 and SF-2 of 100–140. It is particularly preferred that SF-1 is 100–140 and SF-2 is 100–120. A toner prepared by the polymerization process and showing shape factors within the above-described ranges particularly shows a good transfer efficiency and is preferred.

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 500, and 100 images of toner particles having a particle size (diameter) of at least 2 μm are sampled at random. The image data are inputted into an image analyzer ("Luzex 3", available from Nireco K.K.) to obtain averages of shape factors SF-1 and SF-2 based on the following equations:

$$SF\text{-}1=[(MXLNG)^2/AREA]\times(\pi/4)\times100,$$

$$SF\text{-}2=[(PERI)^2/AREA]\times(1/4\pi)\times100,$$

wherein MXLNG denotes the maximum length of a sample particle, PERI denotes the perimeter of a sample particle, and AREA denotes the projection area of the sample particle.

The shape factor SF-i represents the roundness of toner particles, and the shape factor SF-2 represents the roughness of toner particles. If both factors are closer to 100, the particles have shapes closer to true spheres.

The toner used in the present invention may preferably have a weight-average particle size of 1–9 μm, more preferably 2–8 μm, and contain an external additive in the form of fine particles having a weight-average particle size of 0.012–0.4 μm so as to provide a good combination of forming high-quality images and good continuous image forming performance. It is further preferred that the external additive has an average particle size of 0.02–0.3 μm, further preferably 0.03–0.2 μm.

Figure 8:
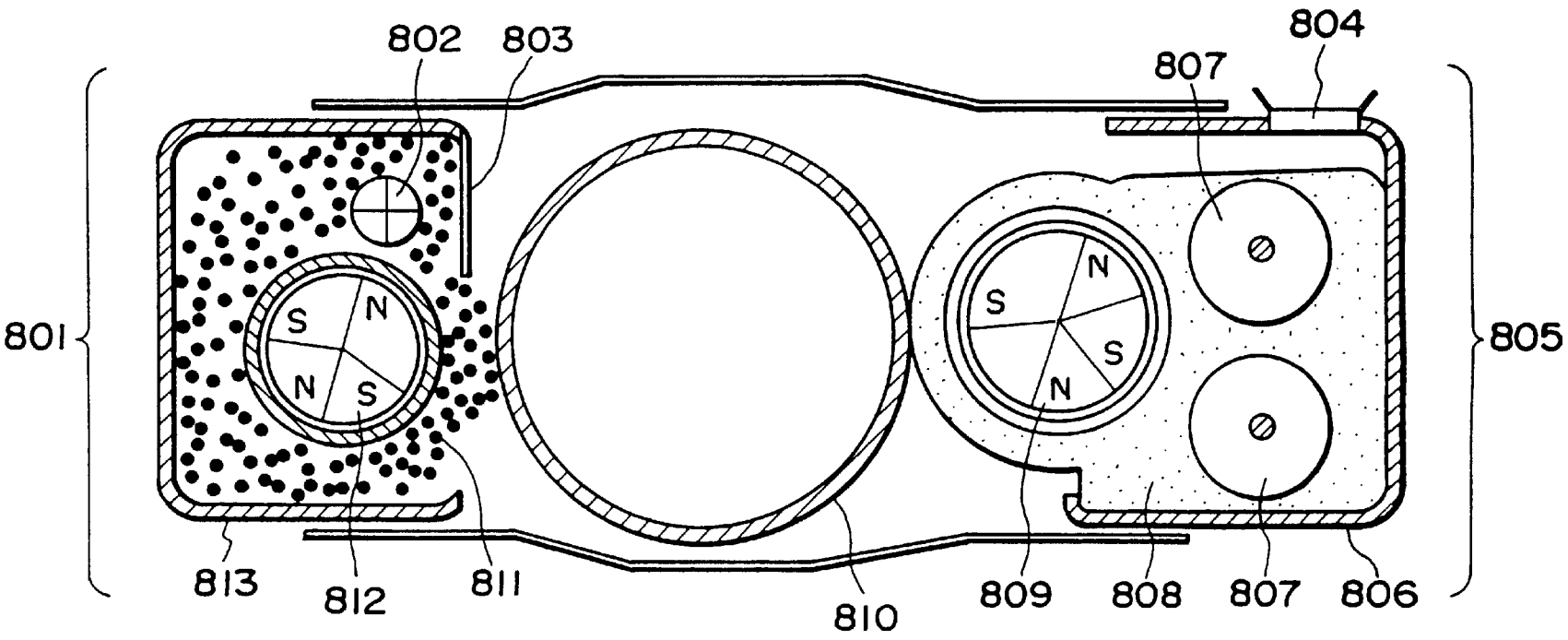
FIGS. 8 and 9 are schematic illustrations of process cartridges including a two-component developing device and a mono-component developing device, respectively.
Figure 9:
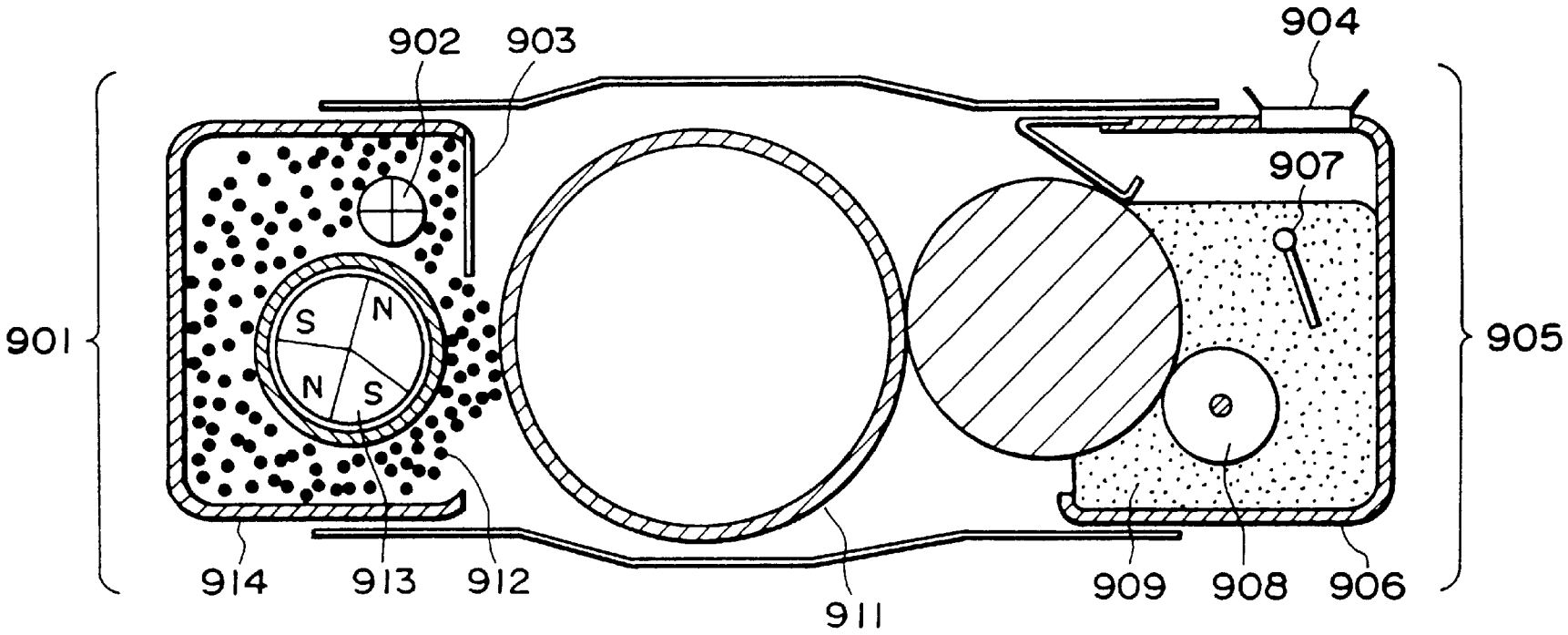

The process cartridge used in the present invention may preferably have a structure allowing further addition of a toner in view of the life of the charging device therein and use of a non-magnetic sleeve enclosing a magnet in the charging device and also from a cost consideration. In this case, the charger magnetic particles may preferably be used in an amount larger than the minimum and may be disposed so as to allow a circulation, thereby providing an extended life thereof as shown in FIGS. 8 and 9 including toner-replenishing ports 804 and 904, respectively. Incidentally, the cartridge shown in FIG. 8 (FIG. 9) further includes a charging device 801 (901), a stirring member 802 (902), a cut blade 803 (903), a developing device 805 (905), a developer vessel 806 containing a developer 808 (a developer vessel 906 containing a toner 909), a developer stirring and feeding screw 807 (a toner stirring member 907), a magnet-enclosing electroconductive sleeve 809 (913), a developing roller (910), a photosensitive member 810 (911), charger magnetic particles 811 (912), a magnetic-enclosing electroconductive sleeve 812 (913) and a vessel 813 (914) for charger magnetic particles.

Figure 5:
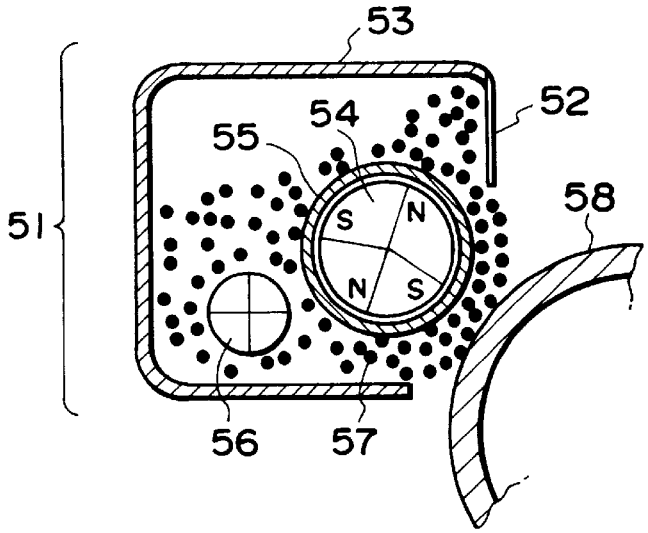
FIGS. 5–7 are respectively a schematic sectional illustration of a charging device (means) equipped with a stirring mechanism.

The circulation means may preferably comprise a mechanical stirring means, a magnetic pole structure causing a circulation of magnetic particles, or a member for moving magnetic particles in a vessel storing the magnetic particles. Examples thereof may include a screw member 56 stirring behind the magnetic brush, a stirring member 66 stirring above the magnetic brush (FIG. 6), a structure including a magnet 74 having a repulsion pole together with a stirring member 76 allowing peeling and re-coating of the magnetic particles, (FIG. 7) or a baffle member for obstructing the flow of magnetic particles. More specifically, the charging system shown in FIG. 5 (FIG. 6 or FIG. 7) includes a charging device 51 (61 or 71), a cut blade 52 (62 or 72), a vessel 53 (63 or 73) for charger magnetic particles, a magnet 54 (64 or 74), a non-magnetic electroconductive sleeve 55 (65 or 75), a stirring member 56 (66 or 76), charger magnetic particles 57 (67 or 77), and a photosensitive member 58 (68 or 78) to be charged thereby.

Hereinbelow, the present invention will be described more specifically based on the following Examples, to which however the present invention should not be construed as limited.

First of all, some production examples for illustrating the organization, the material and the production method of the present invention will be described.

Charger Production Example 1

| | |
|---|---|
| $Fe_2O_3$ | 54 mol. % |
| MnO | 35 mol. % |
| MgO | 11 mol. % |

0.05 wt. part of phosphorus was added to totally 100 wt. parts of the above-listed metal oxides, and the resultant mixture was pulverized and mixed in a ball mill, followed by the addition of a dispersant, a binder and water to form a slurry. The slurry was then dried by a spray drier into particles. After being classified as desired, the particles were calcined at 1200° C. in an atmosphere of adjusted oxygen concentration.

The thus-obtained ferrite was disintegrated and classified into ferrite particles having an average particle size ($Dv_{50\%}$) of 27.6 μm.

The ferrite particles (Charger particles 1) exhibited a volume resistivity of $4\times10^7$ ohm.cm, a magnetization of 57 $Am^2kg$ (57 emu/g) at $8\times10^4$ A/m (1 kOe) and a surface/entirety phosphorus concentration ratio of 30 times. The properties of the ferrite particles are inclusively shown in Table 1 appearing hereinafter together with those of the ferrite particles prepared in the following Production Examples.

Charger Production Example 2

Charger particles 2 (ferrite particles) having an average particle size ($Dv_{50\%}$) of 37.0 μm were prepared in a similar manner as in Production Example 1 but under different classification conditions.

Charger Production Example 3

Charger particles 3 (ferrite particles) having an average particle size ($Dv_{50\%}$) of 28.0 μm were prepared in a similar manner as in Production Example 1 except for adding 0.5 wt. part of phosphorus.

Charger Production Example 4

Charger particles 4 (ferrite particles) having an average particle size ($Dv_{50\%}$) of 27.5 μm were prepared in a similar manner as in Production Example 1 except for adding 1.0 wt. part of phosphorus.

Charger Production Example 5

| | |
|---|---|
| $Fe_2O_3$ | 50 mol. % |
| MnO | 30 mol. % |
| MgO | 20 mol. % |

Charger particles 5 (ferrite particles) having an average particle size of 27.0 μm were prepared in a similar manner as in Production Example 1 except for using the above starting metal oxides and adding 1.0 wt. part of phosphorus.

Charger Production Example 6

Charger particles 6 (ferrite particles) having an average particle size ($Dv_{50\%}$) of 28.5 μm were prepared in a similar manner as in Production Example 1 except for omitting the addition of phosphorus.

Charger Production Example 7

Charger particles 7 (ferrite particles) having an average particle size ($Dv_{50\%}$) of 26.0 μm were prepared in a similar manner as in Production Example 5 except for omitting the addition of phosphorus.

Charger Production Example 8

Charger particles 8 (ferrite particles) were prepared by adding 100 wt. parts of Charger particles 1 prepared in Production Example 1 in a solution of 0.05 wt. part of dodecyltrimethoxysilane (silane coupling agent) in 20 wt. parts of methyl ethyl ketone, and maintaining the mixture at 70° C. under stirring to evaporate the solvent, followed by curing in an oven at 150° C.

The properties of Charger particles 8 are shown in Table 2 appearing hereinafter together with those Charger particles (treated ferrite particles) prepared in the following Production Examples.

Charger Production Example 9

Charger particles 9 (ferrite particles) were prepared by adding 100 wt. parts of Charger particles 1 prepared in Production Example 1 in a solution of 0.05 wt. part of octyltrimethoxysilane (silane coupling agent) in 20 wt. parts of methyl ethyl ketone, and maintaining the mixture at 70° C. under stirring to evaporate the solvent, followed by curing in an oven at 100° C.

Charger Production Example 10

Charger particles 10 (ferrite particles) were prepared by adding 100 wt. parts of Charger particles 1 prepared in Production Example 1 in a solution of 0.05 wt. part of isopropoxy triisostearoyl titanate (titanium coupling agent) in 20 wt. parts of methyl ethyl ketone, and maintaining the mixture at 70 ° C. under stirring to evaporate the solvent, followed by curing in an oven at 200° C.

Charger Production Example 11

Charger particles 11 (ferrite particles) were prepared by adding 100 wt. parts of Charger particles 2 prepared in Production Example 2 in a solution of 0.05 wt. part of isopropoxy triisostearoyl titanate (titanium coupling agent) in 30 wt. parts of methyl ethyl ketone, and maintaining the mixture at 70° C. under stirring to evaporate the solvent, followed by curing in an oven at 200° C.

Charger Production Example 12

Charger particles 12 (ferrite particles) were prepared by adding 100 wt. parts of Charger particles 3 prepared in Production Example 3 in a solution of 0.05 wt. part of isopropoxy triisostearoyl titanate (titanium coupling agent) in 30 wt. parts of methyl ethyl ketone, and maintaining the mixture at 70° C. under stirring to evaporate the solvent, followed by curing in an oven at 200° C.

Charger Production Example 13

Charger particles 13 (ferrite particles) were prepared by adding 100 wt. parts of Charger particles 4 prepared in Production Example 4 in a solution of 0.10 wt. part of isopropoxy triisostearoyl titanate (titanium coupling agent) in 30 wt. parts of methyl ethyl ketone, and maintaining the mixture at 70° C. under stirring to evaporate the solvent, followed by curing in an oven at 200° C.

Charger Production Example 14

Charger particles 14 (ferrite particles) were prepared by adding 100 wt. parts of Charger particles 5 prepared in Production Example 5 in a solution of 0.10 wt. part of isopropoxy triisostearoyl titanate (titanium coupling agent) in 30 wt. parts of methyl ethyl ketone, and maintaining the mixture at 70° C. under stirring to evaporate the solvent, followed by curing in an oven at 200° C.

Charger Production Example 15

Charger particles 15 (ferrite particles) were prepared by adding 100 wt. parts of Charger particles 6 prepared in Production Example 6 in a solution of 0.10 wt. part of γ-glycidoxypropyltrimethoxysilane (silane coupling agent) in 20 wt. parts of methyl ethyl ketone, and maintaining the mixture at 70° C. under stirring to evaporate the solvent, followed by curing in an oven at 100° C.

Charger Production Example 16

Charger particles 16 (ferrite particles) were prepared by adding 100 wt. parts of Charger particles 6 prepared in Production Example 6 in a solution of 0.05 wt. part of γ-methacryloxypropyltrimethoxysilane (silane coupling agent) in 20 wt. parts of methyl ethyl ketone, and maintaining the mixture at 70° C. under stirring to evaporate the solvent, followed by curing in an oven at 100° C.

Charger Production Example 17

| | |
|---|---|
| $Fe_2O_3$ | 53 mol. % |
| CuO | 27 mol. % |
| ZnO | 20 mol. % |

0.2 wt. part of phosphorus was added to totally 100 wt. Parts of the above-listed metal oxides, and the resultant mixture was pulverized and mixed in a ball mill, followed by the addition of a dispersant, a binder and water to form a slurry. The slurry was then dried by a spray drier into particles. After being classified as desired, the particles were sintered at 1000° C.

The sintered particles were disintegrated and classified to provide Charger particles 17 (ferrite particles) having an average particle size ($Dv_{50\%}$) of 28.1 μm. The properties are shown in Table 1.

Charger Production Example 18

| | |
|---|---|
| $Fe_2O_3$ | 50 mol. % |
| MnO | 25 mol. % |
| ZnO | 25 mol. % |

0.2 wt. part of phosphorus was added to totally 100 wt. parts of the above-listed metal oxides, and the resultant mixture was pulverized and mixed in a ball mill, followed by the addition of a dispersant, a binder and water to form a slurry. The slurry was then dried by a spray drier into particles. After being classified as desired, the particles were sintered at 1000° C. in an atmosphere of adjusted oxygen concentration.

The sintered particles were disintegrated and classified to provide Charger particles 18 (ferrite particles) having an average particle size ($Dv_{50\%}$) of 27.9 μm.

Charger Production Example 19

| | |
|---|---|
| $Fe_2O_3$ | 53 mol. % |
| MgO | 25 mol. % |
| ZnO | 17 mol. % |
| MnO | 5 mol. % |

0.2 wt. part of phosphorus was added to totally 100 wt. parts of the above-listed metal oxides, and the resultant mixture was pulverized and mixed in a ball mill, followed by the addition of a dispersant, a binder and water to form a slurry. The slurry was then dried by a spray drier into particles. After being classified as desired, the particles were sintered at 1100° C. in an atmosphere of adjusted oxygen concentration.

The sintered particles were disintegrated and classified to provide Charger particles 19 (ferrite particles) having an average particle size ($Dv_{50\%}$) of 28.3 μm.

Drum Production Example 1

A 30 mm-dia. aluminum cylinder was coated successively with the following five functional layers to form Photosensitive drum 1.

First layer (electroconductive layer): Ca. 20 μm-thick electroconductive particle-dispersed resin layer for smoothing defects on the aluminum cylinder and preventing the occurrence of moire due to reflection of laser light.

Second layer (positive charge injection-prevention layer): Ca. 1 μm-thick medium resistivity layer formed of 6-66-610-12-nylon and methoxy-methylated nylon and adjusted to have a resistivity of ca. $10^6$ ohm.cm for preventing positive charges injected from the aluminum cylinder from diminishing negative charge provided to the photosensitive member surface.

Third layer (charge generation layer): Ca. 0.3 μm-thick oxytitanium phthalocyanine-dispersed resin layer for generating positive and negative charge pairs on exposure to light.

Fourth layer (charge transport layer): Ca. 15 μm-thick hydrazone-dispersed polycarbonate resin layer (p-type semiconductor layer), not allowing the passage of negative charge provided to the photosensitive member surface but selectively transporting positive charge generated in the charge generation layer to the photosensitive member surface.

TABLE 1

| Charger magnetic particles | Resistivity (MΩ.cm) | Composition mol. % MgO | MnO | $Fe_2O_3$ | P content (wt. parts) | $Dv_{50\%}$ (μm) | P conc. ratio (times) |
|---|---|---|---|---|---|---|---|
| 1 | 40 | 11 | 35 | 54 | 0.05 | 27.6 | 30 |
| 2 | 30 | 11 | 35 | 54 | 0.05 | 37.0 | 25 |
| 3 | 60 | 11 | 35 | 54 | 0.5 | 28.0 | 16 |
| 4 | 80 | 11 | 35 | 54 | 1.0 | 27.5 | 13 |
| 5 | 10 | 20 | 30 | 50 | 1.0 | 27.0 | 20 |
| 6 | 30 | 11 | 35 | 54 | 0.0 | 28.2 | — |
| 7 | 9 | 20 | 30 | 50 | 0.0 | 26.0 | — |
| 17 | 50 | CuO 27 | ZnO 20 | 53 | 0.2 | 28.1 | — |
| 18 | 10 | ZnO 25 | 25 | 50 | 1.0 | 27.9 | — |
| 19 | 20 | 25 | 5 | 53 | 0.7 | 28.3 | — |

TABLE 2

| Charger magnetic particles | Base magnetic particles | Treated charger particles Coupling agent** | (wt. part) | Heating loss (wt. %) | Reaction rate (%) |
|---|---|---|---|---|---|
| 8 | 1 | DTMS | 0.05 | 0.05 | 98 |
| 9 | 1 | OTMS | 0.05 | 0.05 | 95 |
| 10 | 1 | IPTST | 0.05 | 0.05 | 100 |
| 11 | 2 | " | 0.05 | 0.02 | 100 |
| 12 | 3 | " | 0.15 | 0.15 | 96 |
| 13 | 4 | " | 0.10 | 0.1 | 95 |
| 14 | 5 | " | 0.10 | 0.1 | 98 |
| 15 | 6 | γ-GPTMS | 0.10 | 0.1 | 90 |
| 16 | 6 | γ-MPTMS | 0.05 | 0.05 | 98 |

**DTMS = dodecyltrimethoxysilane
OTMS = octyltrimethoxysilane
IPTST = isopropoxy triisostearoyl titanate
γ-GPTMS = γ-glycidoxypropyltrimethoxysilane
γ-MPTMS = γ-methacryloxypropyltrimethoxysilane The charge transport layer exhibited a surface layer volume resistivity ($R_{SL}$) of $3\times10^{15}$ ohm.cm.

Fifth layer (charge injection layer): A 3 μm-thick layer comprising 100 wt. parts of photo-cured acrylic resin, 150 parts of ca. 0.03 μm-dia. $SnO_2$ particles provided with a lower resistivity by doping with antimony, 20 wt. parts of ca. 0.25 μm-dia. tetrafluoroethylene particles and 1.2 wt. parts of a dispersion aid.

The charge injection layer exhibited $R_{SL}=2\times10^{13}$ ohm.cm.

Drum Production Example 2

Photosensitive drum 2 was prepared by coating a photosensitive drum (having the same structure as Photosensitive drum 1) prepared in Drum Production Example 1 further with a 3 μm-thick fifth layer (charge injection layer) comprising 100 wt. parts of photo-cured acrylic resin, 170 wt. parts of ca. 0.03 μm-dia. $SnO_2$ particles provided with a lower resistivity by doping with antimony, 20 wt. parts of ca. 0.25 μm-dia. tetrafluoroethylene particles and 1.2 wt. parts of a dispersion aid.

The charge injection layer exhibited $R_{SL}=4\times10^{12}$ ohm.cm.

Toner Production Example 1

| | |
|---|---|
| Polyester resin | 100 wt. parts |
| Metal-containing azo dye | 2 wt. parts |
| Low-molecular weight polypropylene | 3 wt. parts |
| Carbon black | 5 wt. parts |

The above ingredients were dry-blended and then kneaded through a twin-screw kneading extruder set at 150° C. The kneaded product was cooled, pulverized by a pneumatic pulverizer and then pneumatically classified to provide toner particles having a prescribed particle size distribution. The toner particles were externally blended with 1.7 wt. % of hydrophobized titanium oxide particles to provide Toner 1 having a weight-average particle size (D4) of 6.3 μm.

Toner Production Example 2

88 wt. parts of styrene, 12 wt. parts of n-butyl acrylate, 3 wt. parts of low-molecular weight polypropylene, 4 wt. parts of carbon black, 1.2 wt. parts of metal-containing azo dye, and 3 wt. parts of azo-type initiator were mixed to provide a polymerizable monomer composition, which was then suspended in 500 wt. parts of de-ionized water containing 4 wt. parts of calcium phosphate dispersed therein and subjected to 8 hours of polymerization at 70° C. The polymerizate particles were filtered out, washed, dried and classified to provide toner particles.

The toner particles were externally blended with 1.5 wt. % of hydrophobized titanium oxide particles to provide Toner 2 exhibiting D4=6.3 μm.

Toner 2 showed SF-1=125 and SF-2 =115.

Developer Production Example 1

6 wt. parts of Toner 1 prepared in Toner Production Example 1 was blended with 100 wt. parts of silicone resin-coated nickel-zinc ferrite ($Dv_{50\%}$=60 μm) to prepare Developer 1.

Developer Production Example 2

6 wt. parts of Toner 2 prepared in Toner Production Example 1 was blended with 100 wt. parts of acryl-modified silicone resin-coated nickel-zinc ferrite ($Dv_{50\%}$=60 μm) to prepare Developer 2.

The above-prepared Charger particles, Toners and Developers were evaluated according to the following methods and apparatus as will be described in Examples and Comparative Examples appearing hereinafter.

Digital copying machine 1

A commercially available digital copying machine using a laser beam ("GP-55", available from Canon K.K.) was remodeled to provide an electrophotographic apparatus for testing. As an outline, the digital copying machine included a corona charger as charging means for the photosensitive member, a mono-component developing device adopting a mono-component jumping developing scheme as developing means, a corona charger as transfer means, a blade cleaning means, and a pre-charging exposure means. It also included an integral unit (process cartridge) including the charger, the cleaning means and the photosensitive member, and was operated at a process speed of 150 mm/sec. The digital copying machine was remodeled in the following manner.

First, the process speed was increased to 200 mm/sec.

The developing device was remodeled from the one of the mono-component jumping development scheme to one capable of using a two-component type developer. For constituting a magnetic brush charger, a 16 mm-dia. electroconductive non-magnetic sleeve enclosing a magnet roller was disposed with a gap of 0.5 mm from the photosensitive member. A developing bias voltage was set to comprise a DC component of −500 volts superposed with a rectangular AC component of a peak-to-peak voltage of 1000 volts and a frequency of 3 kHz. The transfer means was changed from the corona charger to a roller transfer charger, and the pre-charging exposure means was removed.

Further, the cleaning blade was removed to provide a cleaner-less copying apparatus.

Figure 4:
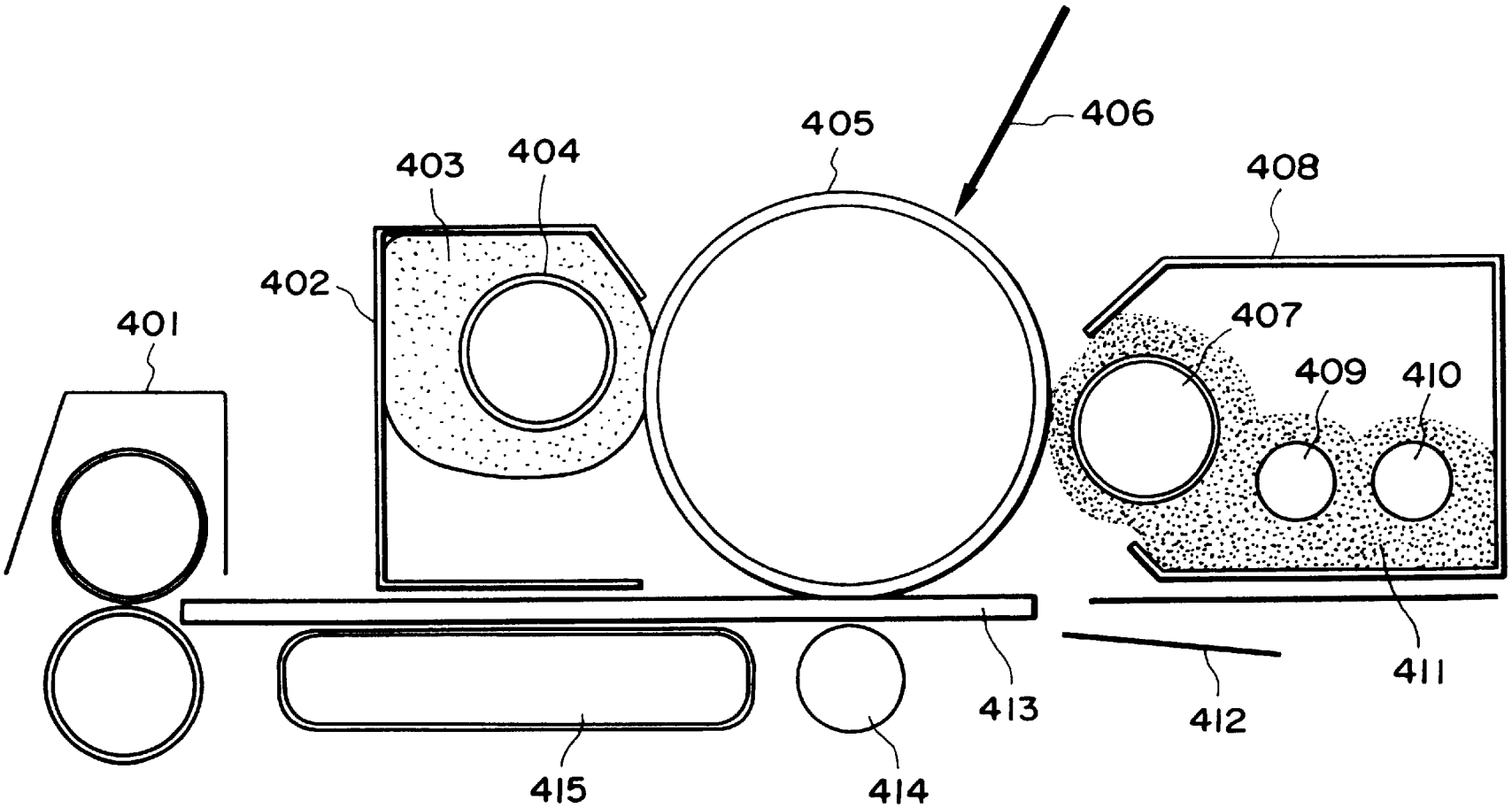
FIG. 4 is an illustration of a digital copying apparatus.

The thus-remodeled copying apparatus had a structure as illustrated in FIG. 4 and included a fixing device 401, a charger unit 402 including charging magnetic particles (Charger particles) 403 and an electroconductive sleeve 404 enclosing a magnet, a photosensitive member (Photosensitive drum) 405, a light source for supplying image light 406, a developing device 408 including a developing sleeve 407, stirring screws 409 and 410 and a developer 411, a transfer material-supply guide 412 for supplying a transfer material 413, a transfer roller 414, and a transfer material-conveyer belt 415.

Evaluation method

For actual evaluation of durability, digital copying machine 1 was used, and changer magnetic particles of at least 30 g were loaded on a sleeve of a charging device at a coating rate of 180 mg/cm , and a photosensitive drum was mounted to be charged thereby.

The image formation was performed continuously on 500 A4-size sheets fed in a lateral direction by using an original having an image ratio of 3% in an environment of 25° C./60% relative humidity. The charger was supplied with a bias voltage comprising a DC component of −700 volts superposed with a rectangular AC component of 700 Vpp (peak-to-peak volts) and 1 kHz. Further, at the time of no image formation during the continuous image formation, i.e., the pre-image formation period prior to the image formation on the first sheet, the period between successively fed sheets of papers and the post-image formation period after the image formation on the 500-th sheet, a superposed voltage of the DC component of −700 volts and an AC component of 1 kHz/300 Vpp was applied so as to send out the transfer residual toner taken in the magnetic brush 403 to the photosensitive member 405.

Such application of a charging bias voltage different from that in the image formation may be performed generally at any time during movement of the photosensitive member without image formation in addition to those specifically mentioned above in this embodiment.

During the image formation, as has been described with reference to FIG. 1, the transfer residual toner is recovered with the magnetic brush, uniformly charged to a polarity identical to that of the photosensitive member 405, sent via the photosensitive member 405 and recovered or used for development by the developing device 408.

Further, as a result of a charging bias voltage application during no image formation, i.e., the period for pre-rotation, between paper supply and post-rotation, the transfer residual toner recovered within the magnetic brush 403 is sent out to the photosensitive member 405 and recovered by the developing device 408 via the photosensitive member.

After each continuous image formation on 20,000 sheets (by repeating 40 cycles of image formation on n500 sheets in each cycle), the charging member was supplied with a superposition of a DC voltage of −700 volts and an AC voltage of 1 kHz/700 Vpp to measure a surface potential of the photosensitive member at that time, thereby obtaining a potential convergence ratio in terms of a ratio of the measured surface potential to the applied DC voltage component (of −700 volts). A potential convergence ratio of 90% or higher indicates a good chargeability, and one of 95% or higher indicates an excellent chargeability.

Examples 1–13

Charger particles 1–5 and 8–14 prepared in the above Production Examples each in an amount of 50 g were respectively loaded in the charging device and evaluated in the above-described manner in combination with Drums (Photosensitive drum) and Developers indicated in Table 3. The respective Charger particles exhibited a stable potential convergence ratio from the initial stage.

However, Charger particles 1–5 prepared without the coating with coupling agents caused somewhat noticeable abrasion of the photosensitive drum, so that the drums were exchanged at the time when fog became noticeable.

The results are inclusively shown in Table 3.

Example 14

Figure 6:
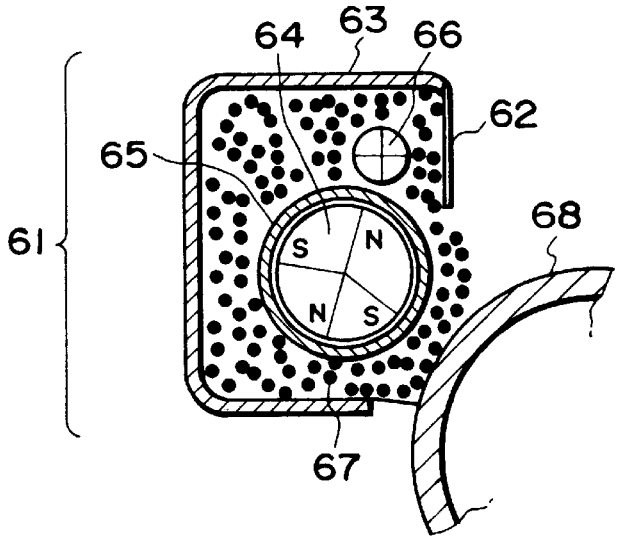
Figure 7:
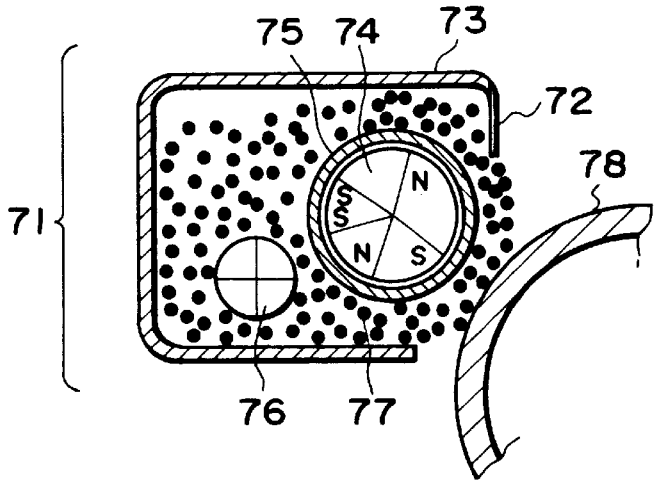

A continuous image formation test was performed similarly as in Example 7 except that 100 g (twice) of Charger particles 8 were loaded in a charging device 61 equipped with a stirring member 66 as shown in FIG. 6 and the charging device was used for the test. As a result, the charging member did not cause a lowering in charging ability up to $13\times10^4$ sheets. At the time of $13\times10^4$ sheets, the resultant images were accompanied with fog due to the abrasion of the photosensitive member, so that the test was stopped.

Comparative Example 1

A continuous image formation test was performed similarly as in Example 1 except for using Charger particles 6 prepared in Production Example 6.

The charger particles exhibited good performances up to $6\times10^4$ sheets, but the charging ability was lowered from ca. $8\times10^4$ sheets.

Comparative Example 2

A continuous image formation test was performed similarly as in Example 1 except for using Charger particles 7 prepared in Production Example 7.

The charging ability at the initial stage was good and good continuous image forming performance was exhibited up to ca. $6\times10^4$ sheets, but the charging ability was remarkably lowered due to deterioration from ca. $8\times10^4$ sheets.

Comparative Example 3

A continuous image formation test was performed similarly as in Example 1 except for using Charger particles 15 prepared in Production Example 15.

The charging ability at the initial stage was good and good continuous image forming performance was exhibited up to ca. $6\times10^4$ sheets, but the charging ability was remarkably lowered due to deterioration due to deterioration from ca. $8\times10^4$ sheets. Further, regardless of the treatment with a coupling agent, Charger particles 15 resulted in a life of photosensitive member similarly as without the coupling agent. This is because Charger particles 15 failed to satisfy the composition of the present invention and the coupling agent exhibited insufficient lubricity because of lack of a long-chain alkyl group.

Comparative Example 4

A continuous image formation test was performed similarly as in Example 1 except for using Photosensitive drum 2 prepared in Production Example 2, Charger particles 16 prepared in Production Example 16.

The charging ability at the initial stage was good and good continuous image forming performance was exhibited up to ca. $6\times10^4$ sheets, but the charging ability was remarkably lowered due to deterioration due to deterioration from ca. $8\times10^4$ sheets. Further, regardless of the treatment with a coupling agent, Charger particles 16 resulted in a life of photosensitive member similarly as without the coupling agent. This is because Charger particles 16 failed to satisfy the composition of the present invention and the coupling agent exhibited insufficient lubricity because of lack of a long-chain alkyl group.

Comparative Example 5

A continuous image formation test was performed similarly as in Example 1 except for using Charger particles 17 prepared in Production Example 17.

As a result, the charging ability was good up to $6\times10^4$ sheets but started to be lowered from $8\times10^4$ sheets, when also fog occurred due to abrasion of the photosensitive member. Accordingly, the test was continued by renewing the photosensitive member, but the charging ability was clearly lowered at $10\times10^4$ sheets.

Comparative Example 6

A continuous image formation test was performed similarly as in Example 1 except for using Charger particles 18 prepared in Production Example 18.

As a result, the charging ability was lowered at $8\times10^4$ sheets.

Comparative Example 7

A continuous image formation test was performed similarly as in Example 1 except for using Charger particles 19 prepared in Production Example 19.

As a result, the charging ability started to be lowered from $6\times10^4$ sheets and exhibited a clear lowering at $8\times10^4$ sheets.

TABLE 3

| Ex. or Comp. Ex. | Charger magnetic particles | amount (g) | Drum | Devel-oper | T.C.*1 (mC/kg) | Potential convergenace ratio (%) at × $10^4$ sheets Initial | 2 | 4 | 6 | 8 | 10 | Life of drums (sheets) |
|---|---|---|---|---|---|---|---|---|---|---|---|---|
| Ex. | | | | | | | | | | | | |
| 1 | 1 | 50 | 1 | 1 | −15 | 97 | 96 | 96 | 94 | 93 | 90 | 80000 |
| 2 | 1 | 50 | 1 | 2 | −17 | 97 | 96 | 96 | 94 | 93 | 92 | 80000 |
| 3 | 2 | 50 | 2 | 2 | −16 | 97 | 96 | 96 | 90 | 90 | 85 | 80000 |
| 4 | 3 | 50 | 2 | 2 | −14 | 97 | 96 | 95 | 95 | 94 | 93 | >100000 |
| 5 | 4 | 50 | 2 | 2 | −15 | 93 | 92 | 93 | 91 | 91 | 90 | >100000 |
| 6 | 5 | 50 | 2 | 2 | −15 | 97 | 96 | 96 | 96 | 95 | 94 | >100000 |
| 7 | 8 | 50 | 2 | 2 | −26 | 97 | 97 | 97 | 96 | 96 | 95 | >100000 |
| 8 | 9 | 50 | 2 | 2 | −25 | 96 | 96 | 95 | 96 | 96 | 95 | >100000 |
| 9 | 10 | 50 | 2 | 2 | −28 | 96 | 95 | 95 | 96 | 96 | 95 | >100000 |
| 10 | 11 | 50 | 2 | 2 | −30 | 95 | 95 | 93 | 92 | 91 | 88 | >100000 |
| 11 | 12 | 50 | 2 | 2 | −28 | 96 | 95 | 95 | 95 | 96 | 95 | >100000 |
| 12 | 13 | 50 | 2 | 2 | −29 | 93 | 93 | 93 | 93 | 91 | 90 | >100000 |
| 13 | 14 | 50 | 2 | 2 | −29 | 96 | 94 | 94 | 93 | 94 | 94 | >100000 |
| 14 | 8 | 100 | 2 | 2 | −26 | 97 | 96 | 96 | 96 | 96 | 96 | 130000*2 |
| Comp. Ex. | | | | | | | | | | | | |
| 1 | 6 | 50 | 1 | 1 | −15 | 96 | 94 | 92 | 89 | 78 | | 80000 |
| 2 | 7 | 50 | 1 | 1 | −16 | 96 | 95 | 93 | 90 | 80 | — | 80000 |
| 3 | 15 | 50 | 1 | 1 | −25 | 96 | 95 | 93 | 91 | 82 | — | 80000 |
| 4 | 16 | 50 | 2 | 1 | −20 | 96 | 94 | 93 | 92 | 83 | — | 80000 |
| 5 | 17 | 50 | 2 | 2 | −12 | 96 | 95 | 93 | 92 | 88 | 76 | 80000 |
| 6 | 18 | 50 | 2 | 2 | −14 | 96 | 94 | 93 | 90 | 81 | — | 80000 |
| 7 | 19 | 50 | 2 | 2 | −13 | 96 | 93 | 91 | 88 | 77 | — | 80000 |

*1T.C. = triboelectric charge
*2Exhibited a potential conversion ratio of 96% at 13 × $10^4$ sheets.

What is claimed is:

1. An electrophotographic apparatus comprising:

an electrophotographic photosensitive member;

charging means including a charging member formed of magnetic particles and disposed to be contactable to the photosensitive member so as to charge the photosensitive member based on a voltage applied thereto, exposure means for exposing said electrophotographic photosensitive member to light to form a latent image thereon;

developing means for developing the latent image with toner; and transfer means for transferring the developed latent image onto a recording medium;

wherein the magnetic particles comprise ferrite particles comprising ferrite having a composition represented by the formula of:

$$(MnO)_x(MgO)_y(Fe_2O_3)_z,$$

wherein x, y and z are numbers satisfying $x+y+z<1$, $0.2<x<0.5$, $0.05<y<0.25$, and $0.4<z<0.6$, and 0.01–3 wt. parts of phosphorus are added per 100 wt. parts of the ferrite and contained preferentially at a larger concentration at the surfaces of the magnetic particles than in the entirety of the magnetic particles.

2. An apparatus according to claim 1, wherein the phosphorus is present at the surfaces of the magnetic particles at a concentration which is at least 5 times that in the entirety of magnetic particles.

3. An apparatus according to claim 1, wherein the phosphorus is present at the surfaces of the magnetic particles at a concentration which is at least 10 times that in the entirety of magnetic particles.

4. An apparatus according to claim 1, wherein the magnetic particles have a volume resistivity of $1\times10^4$–$1\times10^9$ ohm.cm.

5. An apparatus according to claim 1, wherein the magnetic particles have an average particle size of 5–100 $\mu$m.

6. An apparatus according to claim 1, wherein the magnetic particles are surface-treated with a coupling agent having a linear alkyl group including at least 6 carbon atoms.

7. An apparatus according to claim 1, wherein the developing means functions to recover a portion of toner supplied from the developing means and remaining on the photosensitive member after passing by the transfer means.

8. An apparatus according to claim 7, wherein said apparatus is without cleaning means for recovering and storing the toner remaining on the photosensitive member between the transfer means and the charging means or between the charging means and the developing means.

9. A process cartridge comprising:

an electrophotographic photosensitive member; and charging means including a charging member formed of magnetic particles and disposed to be contactable to the photosensitive member so as to charge the photosensitive member based on a voltage applied thereto, wherein the magnetic particles comprise ferrite particles comprising ferrite having a composition represented by the formula of:

$$(MnO)_x(MgO)_y(Fe_2O_3)_z,$$

wherein x, y and z are numbers satisfying $x+y+z\leqq1$, $0.2<x<0.5$, $0.05<y<0.25$, and $0.4<z<0.6$, and 0.01–3 wt. parts of phosphorus are added per 100 wt. parts of the ferrite and contained preferentially at a larger concentration at the surfaces of the magnetic particles than in the entirety of the magnetic particles, and wherein said electrophotographic photosensitive member and said charging means are integrally supported to form a cartridge which is detachably mountable to a main assembly of an electrophotographic apparatus.

10. A process cartridge according to claim 9, wherein the phosphorus is present at the surfaces of the magnetic particles at a concentration which is at least 5 times that in the entirety of magnetic particles.

11. A process cartridge according to claim 9, wherein the phosphorus is present at the surfaces of the magnetic particles at a concentration which is at least 10 times that in the entirety of magnetic particles.

12. A process cartridge according to claim 9, wherein the magnetic particles have a volume resistivity of $1\times10^4$–$1\times10^9$ ohm.cm.

13. A process cartridge according to claim 9, wherein the magnetic particles have an average particle size of 5–100 $\mu$m.

14. A process cartridge according to claim 9, wherein the magnetic particles are surface-treated with a coupling agent having a linear alkyl group including at least 6 carbon atoms.

* * * * *

UNITED STATES PATENT AND TRADEMARK OFFICE

CERTIFICATE OF CORRECTION

PATENT NO. : 6,026,260

DATED : February 15, 2000

INVENTOR(S): SHUICHI AITA, ET AL.

It is certified that error appears in the above-identified patent and that said Letters Patent is hereby corrected as shown below:

COLUMN 1:
Line 32, "occurs" should be deleted.
Line 57, "a" should be deleted.

COLUMN 2:
Line 4, "make" should read --made--.

COLUMN 3:
Line 57, "chronium" should read --chromium--.

COLUMN 9:
Line 65, "P." should read --P,--.

COLUMN 10:
Line 34, "leak" should read --to leak--.
Line 50, "cum-ulatively" should read --cumulatively--.
Line 62, "ozone-less less" should read --ozoneless--.

COLUMN 13:
Line 39, "ca." should read --about--.

COLUMN 14:
Line 47, "change" should read --changed--.

UNITED STATES PATENT AND TRADEMARK OFFICE

CERTIFICATE OF CORRECTION

PATENT NO. : 6,026,260

DATED : February 15, 2000

INVENTOR(S): SHUICHI AITA, ET AL.

It is certified that error appears in the above-identified patent and that said Letters Patent is hereby corrected as shown below:

COLUMN 15:
Line 18, "SF-i" should read --SF-1--.

COLUMN 18:
Line 41, "Parts" should read --parts--.

COLUMN 22:
Line 32, "180 mg/cm ," should read --180 mg/cm,--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*